United States Patent [19]

Sardella et al.

[11] Patent Number: 4,500,244

[45] Date of Patent: Feb. 19, 1985

[54] AIR LIFT FOR BLANK STACKERS

[75] Inventors: Louis M. Sardella, Towson; William F. Ward, Sr., Hampstead, both of Md.

[73] Assignee: The Ward Machinery Company, Cockeysville, Md.

[21] Appl. No.: 450,994

[22] Filed: Dec. 20, 1982

[51] Int. Cl.[3] ..... B65G 57/30

[52] U.S. Cl. ..... 414/92; 271/195; 271/211; 271/212; 414/114; 414/903

[58] Field of Search ..... 414/114, 92, 93, 94, 414/116, 903; 271/177, 195, 211, 212

[56] References Cited

U.S. PATENT DOCUMENTS

| | | | |
|---|---|---|---|
| 2,806,696 | 9/1957 | Bishop . | |
| 2,882,048 | 4/1959 | Smith | 271/211 |
| 2,963,177 | 12/1960 | Shields | 414/92 X |
| 3,224,761 | 12/1965 | Meyer-Jagenberg | 271/195 |
| 3,871,539 | 3/1975 | Nikkel | 414/92 X |
| 3,971,554 | 7/1976 | Stange | 271/212 X |
| 4,062,536 | 12/1977 | Michelson | 271/195 |

FOREIGN PATENT DOCUMENTS

| | | | |
|---|---|---|---|
| 56-37959 | 4/1981 | Japan | 271/212 |

*Primary Examiner*—Leslie J. Paperner
*Attorney, Agent, or Firm*—Boyce C. Dent

[57] ABSTRACT

Apparatus for directing a flow of air between the bottom blank of a stack and a blank advancing beneath the stack, particularly for corrugated paperboard counter stacker machines, comprising an air supply means adjacent the trailing edge of the bottom blank adapted to direct the flow of air beneath the bottom blank and above the advancing blank to form a cushion of air therebetween for reducing sliding friction between such blanks.

4 Claims, 3 Drawing Figures

AIR LIFT FOR BLANK STACKERS

BACKGROUND OF THE INVENTION

Several different types of blank stackers are used in the corrugated paperboard industry, one type of which is used to stack folded, flat carton blanks as they are discharged from a blank folding and gluing machine. Prior to stacking, the blanks have usually been printed, creased, slotted, glued, and folded as well understood by those skilled in the art. At this point, the blanks have been made into flat, collapsed folded boxes which can be later erected for filling of goods. The next step is to collect them in stacks to be tied into bundles for shipment to the ultimate user. The blanks are usually counted as they are stacked and the stacker (sometimes called a counter ejector) is adapted to discharge stacks of a predetermined number of blanks.

Counter-ejectors of the type to which this invention is directed form the stacks of blanks by receiving the advancing blanks one at a time beneath the stack. Examples of such machines may be found in Ward U.S. Pat. No. 3,744,649, Shields U.S. Pat. No. 3,203,561, and Nelson U.S. Pat. No. 3,834,290. A common characteristic of these machines is that the stack of blanks is formed from the bottom, that is, the blanks advance one at a time beneath the stack being formed. And, they simultaneously share a common problem which is that the blanks entering beneath the stack often hang up due to friction between them and the bottom blank of the stack. Such friction results from the frictional coefficient of the paper as well as the weight of the stack acting upon the blanks entering beneath the stack.

Besides hanging or jamming up in the stacker, which interrupts production, another problem is that the printing on the blanks, while usually dry at this point, is subject to scuffing due to sliding friction between the bottom blank of the stack and the blank entering. And, if the blank entering tends to hang up, the blank is scuffed on the bottom by the endless conveyor belts that advance the blanks beneath the stack. Accordingly, an object of the present invention is to provide a means for reducing jamups in carton blank-stacking machines. Another object is to reduce scuffing of the carton blanks as they are stacked in such machines. These and other objects and novel features are generally accomplished by the invention, a summary of which appears below.

SUMMARY OF THE INVENTION

This invention contemplates apparatus for directing a flow of air between the bottom blank of a stack and a blank advancing beneath the stack to form a cushion of air between the blanks to reduce friction therebetween. The apparatus includes an air supply nozzle positioned adjacent the trailing edge of the bottom blank which directs the air beneath the bottom blank and above the advancing blank. The nozzle is formed with a discharge slot that extends at least part way across the width of the blanks so that a thin sheet of air is directed between the blanks so as to spread outwardly toward their outside edges as the advancing blank enters beneath the stack. An air pump, such as a motorized fan, supplies air to the nozzle via appropriate connecting ducts. A damper is provided in the air supply ducts to vent the air under pressure to atmosphere to control the volume being supplied. Alternatively, the air pump speed may be controlled. If desired, the flow of air may be supplied intermittently, beginning with the leading edge and ending with the trailing edge of the advancing blanks.

The invention is preferably applied to a blank stacker of the type including rotating endless conveyor belts upon which the stack rests and which advance an oncoming blank beneath the stack. Suitable restraints are used to stop the advance of the oncoming blank so that a stack is formed by a succession of such blanks. Once a stack of blanks containing a desired number is formed, an ejector mechanism discharges the stack from the machine and another stack immediately begins forming. The air directed between the bottom blank of the stack and the advancing blank reduces the sliding friction therebetween thereby preventing the advancing blanks from jamming in the machine and preventing scuffing otherwise resulting from sliding contact of the blanks and of the conveyor belts.

BRIEF DESCRIPTION OF THE DRAWINGS

In the drawings wherein like parts are marked alike.

DESCRIPTION OF THE PREFERRED EMBODIMENT

Figure 1:
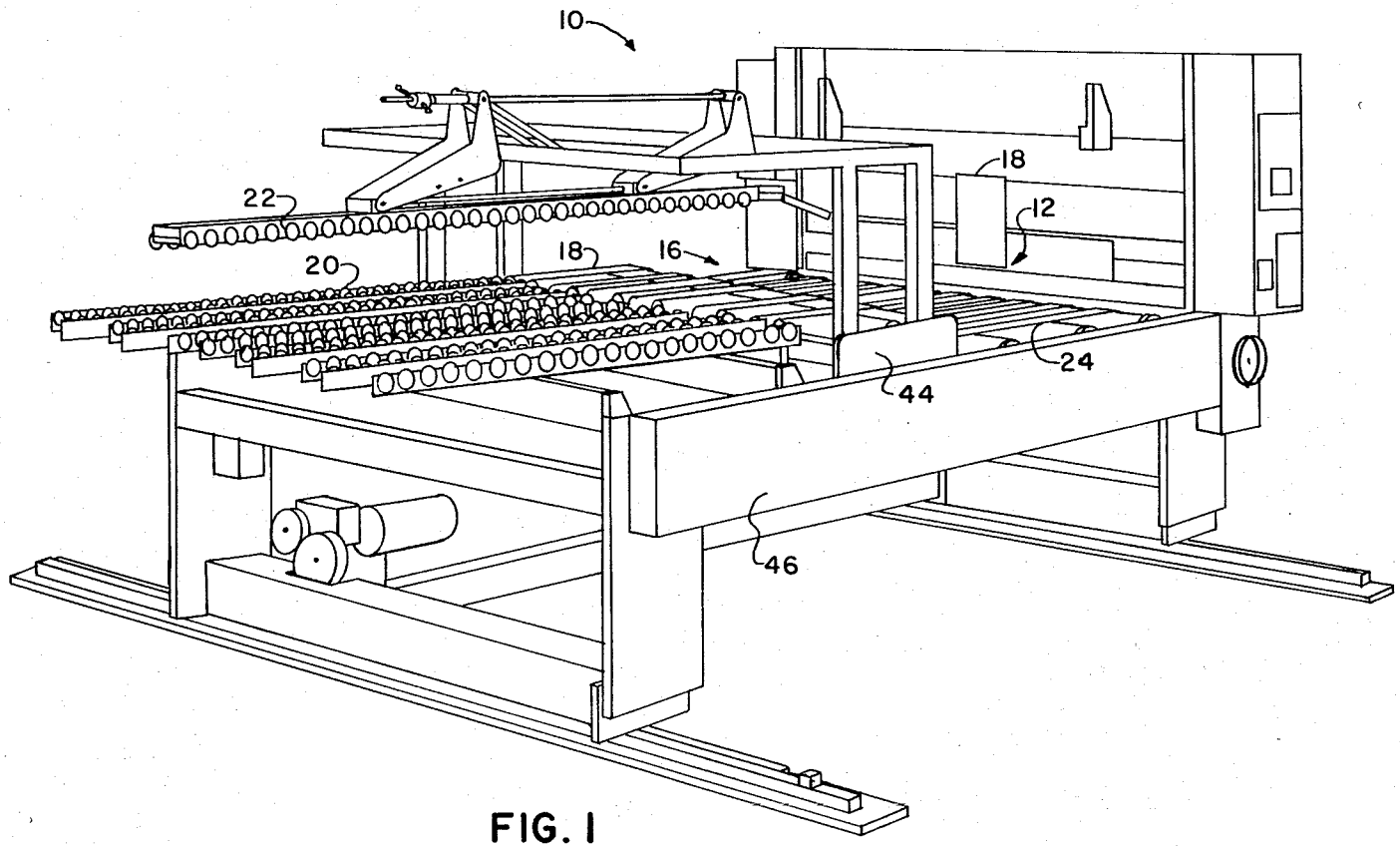
FIG. 1 is an isometric view of one type of blank stacker to which the present invention may be applied.

A blank stacking machine of the type to which the present invention may be applied is schematically illustrated in FIG. 1 and generally designated by numeral 10. Such machine includes a hopper section 12 upon which a stack of blanks 14 (FIG. 2) is formed. When the stack 14 contains the desired number of blanks (as determined by a blank counter—not shown), the stack 14 is pushed into a compression section 16 by a pusher assembly 18. The compression section 16 includes first a number of driven endless conveyor belts 19 which pull the stack 14 away from the pusher 18 and onto a roller skate conveyor 20. The stack 14 is compressed firmly against the belts 19 and conveyor 20 by an upper roller skate conveyor 22. The upper conveyor 22 is adjustable vertically to accommodate stacks 14 of different heights.

The foregoing assemblies are supported by the machine frame substantially as shown in FIG. 1, a description of which is not necessary because the machine is conventional and well known to those skilled in the art.

Figure 2:
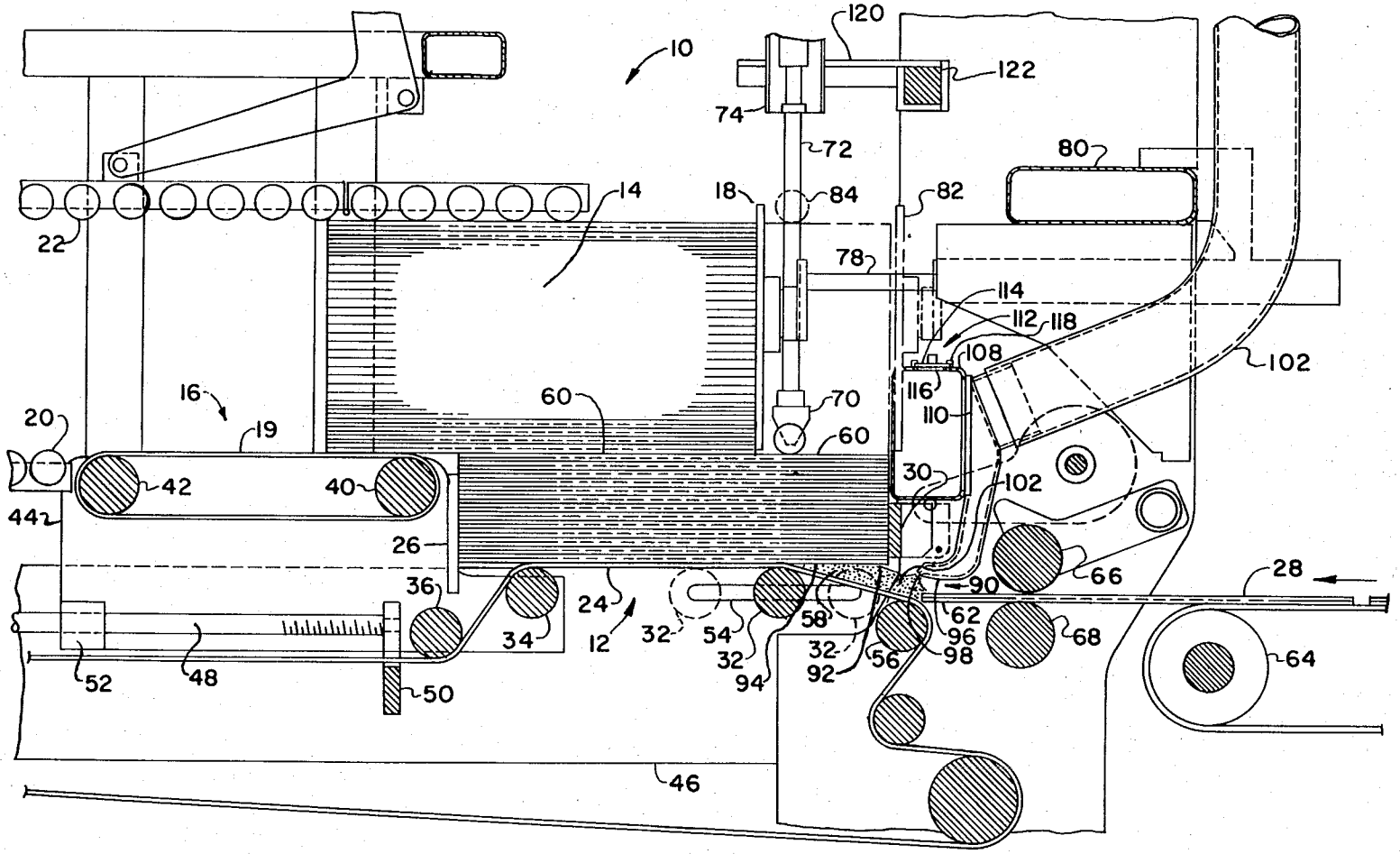
FIG. 2 is a schematic illustration in side elevation of the machine of FIG. 1 showing the application of the invention to such machine.

Referring now to FIG. 2, the stack 14 is supported from beneath by a number of driven, laterally spaced endless conveyor belts 24. A backstop 26 stops the advance of the individual blanks 28 entering beneath the stack 14. A reciprocating spanker plate 30 pushes the blanks 28 in the lower part of the stack 14 against the backstop 26 to square the blanks as well understood by those skilled in the art. Thus, the belts 24, backstop 26, and spanker plate 30 form hopper section 12 in which stack 14 is formed. The belts 24 pass around rollers 32, 34, and 36 as shown in FIG. 2. Endless belts 19 in the compression section 16 pass around rollers 40 and 42. The rollers 34, 36, 40 and 42 are rotatably mounted to a carriage 44 which is longitudinally movable along the main side frames 46 of the machine 10. The backstop 26 is also mounted to the carriage 44. The length of the hopper section 12 is changed by moving the carriage 44 to accommodate the length of blanks 28 being run. The carriage 44 is moved by turning a longitudinally extending screw shaft 48 which is anchored for rotation in a bracket 50 secured to frames 48. Screw shaft 48 passes through an internally threaded bracket 52 secured to the carriage 44; thus, upon rotation of screw shaft 48, the threaded bracket 52 moves along shaft 48, moving carriage 44 with it.

The jump roller 32 near the front of the hopper section 12 is also movable longitudinally in guideways 54 in both side frames 46. The dashed circles indicate the limit of movement in both directions from the center position shown. A handwheel for moving the roller longitudinally and a suitable lock (neither of which is shown) are provided. The purpose of such movement is to change the inclined angle of the belts 24 between roller 32 and another roller 56 around which the belts 24 pass. For longer blanks, the angle is usually decreased by moving roller 32 to the left so that the blanks 28 do not bend as much as they enter beneath the stack 14. Conversely, the roller 32 is moved to the right for shorter blanks. As can be seen in FIG. 2, the inclined angle of belts 24 form a nip 58 between belts 24 and the bottom blank 28 of stack 14. This nip is required to permit blanks 28 to enter beneath stack 14 without hitting the trailing edge of the bottom blank. As well known by those skilled in the art, the blanks 28 include two lateral creases 60 which are indicated on the blanks 28 at the point where the solid lines become dashed lines; such creases separate the center body of the blank from the leading and trailing flaps which themselves form the top and bottom of an erected box. The roller 32 is shown positioned in alignment with the trailing crease 60 but in actual practice, the roller is set so that, preferably, the leading edge 62 of the advancing blank hits the body of the bottom blank in stack 14. However, on blanks with long trailing edge flaps, roll 32 may be positioned so that the leading edge 62 hits the flaps. Care is taken to be sure that the leading edge does not hit the lateral scores 60 since doing so usually causes the advancing blank to jam in the hopper section 12. The advancing blanks 28 are supplied from a conventional folder-gluer machine the tail pulley of which is identified by numeral 64. The blanks enter the stacker 10 between a pair of feed rolls 66 and 68 of which the upper roll 66 is pivotally mounted as shown to accommodate thickness variations in the blanks. The thickness variations occur because the blanks are folded and glued; at this point, the glue may not be dry and the blanks have a tendency to spring open.

As a blank 28 passes between the feed rollers 66 and 68, its leading edge 62 engages the inclined portion of belt 24 and is guided upwardly beneath the trailing end of the stack 14. At this point, the blank is driven by both the feed rolls 66 and 68 and the belts 24. The weight of the stack 14 presses the blanks against belts 24. Blank 24 stops when its leading edge 62 hits the backstop 26. As another blank enters beneath the stack, the preceding blank is lifted above it. As the stack rises, the spanker plate 30 forces the blanks against the backstop 26 and squares them. The trailing end portion of the stack 14 is also held down against the belts 24 by a stabilizer assembly 70 which includes a bar 72 that is freely movable vertically within a support housing 74. The stabilizer 70 prevents the trailing portion of the stack 14 from bouncing as a blank 28 enters beneath the stack 14.

When the number of blanks 28 in stack 14 reaches a desired number (as determined by a preset counter—not shown), the pusher assembly 18 is activated which pushes the desired number of blanks off the top of the stack. FIG. 2 shows the pusher 18 extended and pushing the stack 14 off the top of the bottom portion of the stack 14 which is held against backstop 26. The pusher 18 is extended and retracted by a conventional pneumatic cylinder 78 suitably anchored to a cross member 80. When retracted, the pusher sits behind the stack 14 as indicated by the dashed line 82. The stabilizer 70 is shown against the top of the stack 14 remaining in the hopper 12; however, prior to the top portion of the stack being pushed, the stabilizer 70 is on top of the stack as indicated by the dashed line 84. As the top portion of stack 14 is pushed by pusher 18, it passes between belts 19 of compression section 16 and the upper skate conveyor 22. The belts 19 rotate at approximately the same speed as the advance of pusher 18 so that the stack or bundle (as it is now called at this point) is quickly removed from the hopper 12. The belts 19 also advance the bundle onto the lower skate conveyor 20 where it is held in compression by upper skate conveyor assembly 22. At this location, the bundle may be tied or strapped for shipment and can be moved off the lower conveyor 20 by hand. It may also be pushed onto another conveyor (not shown) by succeeding bundles advanced by belts 19.

As previously mentioned, the blanks 28 often jam as they enter the hopper 12 due to the high coefficient of friction of the paper used to make the blanks and from the weight of stack 14 on the entering blank. In addition, the stabilizer 70 pushes down on the trailing portion of the stack above the nip point 58 where the leading edge 62 of the advancing blank enters beneath the stack 14.

In accordance with the present invention, an air supply means generally denoted by number 90 is placed adjacent the trailing edge 92 of the bottom blank 94 of stack 14 for directing a flow of air between the bottom blank 94 and advancing blank 28 to form a cushion of air between such blanks as blank 28 enters hopper 12 beneath the stack 14. Air supply means 90 includes a nozzle 96 with an air discharge slot 98 which extends at least partially across the width of the bottom blank 94 (or advancing blank 28 since both are of the same width—see FIG. 2). The slot 98 will, of course, extend completely across narrower blanks. The nozzle 96 is connected to an air pump means 100 which applies air under pressure to the slot 98 for discharge between the bottom blank 94 and the advancing blank 28. The air is discharged from the slot 98 in a thin stream or sheet (represented by the dotted area 102) beneath the trailing edge 92 of bottom blank 94 and then, as the blank 28 advances, on top of blank 28 as the blank continues to advance. And, as blank 28 advances beneath stack 14, the air spreads toward the outer edges of the blanks forming the cushion of air between the blanks. In effect, the air lifts the stack 14 an amount such that there is little, if any, contact between the bottom blank 94 and the advancing blank 28 during entry of the advancing blank beneath the stack 14. The air pressure against the advancing blank 28 also forces it against the belts 24 so that they continue to advance the advancing blank. The cushion of air overcomes the friction between the blanks thereby permitting the advancing blank 28 to enter the hopper 12 without jamming and also reduces the scuffing that usually occurs between the blanks.

The slot 98 is made so that its width is about one-third to full width of the blanks being run, it being understood that different width blanks are usually run on the same machine. Thus, in one instance, the slot 98 may be only one-third the width of a blank while, in a second instance, the slot may be the full width of the blank or more. A nozzle width of twenty inches is sufficient for the more common sizes of blanks run on the machine previously described.

The nozzle opening 98 is preferably about three-sixteenths of an inch but may range from one-sixteenth to one-quarter of an inch. When the opening is less, too little air is supplied to form the desired cushion; when more, too much air is supplied which presses the advancing blank too tightly against the belts 24 causing excessive rubbing friction between the advancing blank 28 and belts 24 when the blank stops against the backstop 26.

The nozzle 96 is preferably inclined so that the air stream is applied about forty degrees from horizontal; if less than thirty degrees, a low stack in the hopper may flutter and, if greater than fifty degrees, the air will not be directed between the blanks. The nozzle 96 is also located so that the slot 98 is about one-half inch away from the trailing edge of the stack 14 being formed and about even with the plane of the bottom of the bottom blank 94 in the stack. If the slot 98 is placed farther away or too far above or below the plane, the air will not enter properly between the blanks.

Air supplied through slot 98 at a static pressure equal to about 7 inches of water will produce a velocity of about 7000 feet per minute and will require about 500 cubic feet of air per minute. The air is preferably supplied at a maximum exit velocity between 5000–8000 feet per minute but may be reduced to about 500 feet per minute depending somewhat upon the size of the blanks being run. A damper means (to be described) is used to vary the static pressure to provide the velocity needed in accordance with actual working conditions. More specifically, the air pump means 100 may be a pressure blower such as blower model PB10 rated at 500 cubic feet per minute at 3450 revolutions per minute such as made and sold by the Cincinnati Fan & Ventilator Co., Cincinnati, Ohio 45242 which is mounted on a support bracket 101 on the machine side frame 103. The fan 100 is connected to the nozzle 96 by conventional rigid or flexible air ducts 102 and 104 which branch from the outlet 106 of the fan (see FIG. 2). The ducts 102 and 104 terminate in a plenum 108 which conveniently also serves as a cross support member for stacker 10. The nozzle 96 is fitted over an opening 110 in plenum 108 so that the air in plenum 108 flows through the slot 98 in the nozzle 96.

Figure 3:
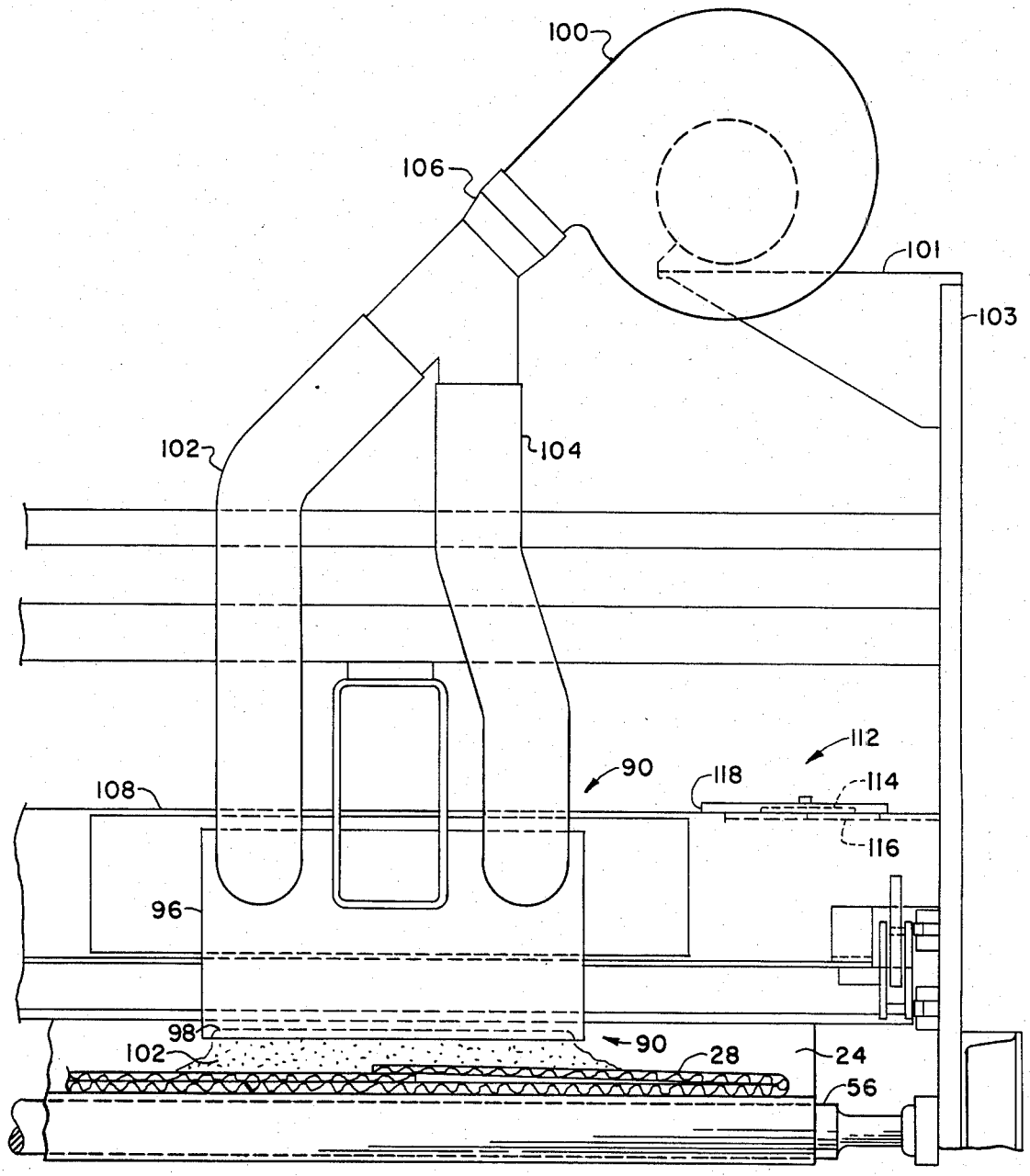
FIG. 3 is a schematic illustration in front elevation showing the arrangement of FIG. 2 from the front.

A simple damper means 112 is provided in plenum 108 as a control means to control the volume of air discharged by nozzle 96 by venting the air in the plenum to atmosphere. Damper 112 comprises a slidable plate 114 placed over an opening 116 in the wall of plenum 108. The plate 114 is held in place by angles 118 secured to the plenum. Thus, by sliding plate 114, more or less of the opening 116 may be opened to atmosphere. Damper plate 114 is shown partially open in FIG. 3.

If desired, the air pump 100 may be provided with a conventional electric speed control circuit (not shown) which can be used to run the fan at less than maximum speed to reduce the volume of air supplied to the nozzle 96.

The blanks 28 discharged from the folding machine 64 usually follow one another very closely, for example, from one to about 50 inches apart. Thus, the air supplied by nozzle 96 is preferably supplied continuously. However, if, for some reason, the blanks are spaced further apart, or if the folding machine is run very slowly, the air can be supplied intermittently. In this event, suitable detection means, such as a photo electric cell (not shown), may be used to detect the advance of a blank 28 and to turn on the air pump 100 for the required amount of time. Alternatively, the pump 100 may be run continuously and the damper opened and closed automatically by a suitable mechanism (not shown). It is also possible to provide a valve means (not shown) to open and close the slot 98 to provide an intermittent flow of air.

In operation, the carriage 44 is positioned for the size blanks 28 being run by moving it toward the spanker plate 30. The jump roll 32 is positioned so that the leading edges 62 enter the nip 58 beneath the body of the bottom blank 94 or, at least, do not hit the lateral score line 60 as previously described. The blank counter (not shown) is set for the desired number of blanks in the final bundle and the compression skate conveyor 22 is lowered to provide compression against the final bundle. The stabilizer 70 is positioned along bar 120 so that is is approximately vertically over the jump roll 32. Stabilizer 70 may also be positioned laterally along bar 122 so that it does not rest on a slot (not shown) in the blanks 28. Then, the folding machine 64 is turned on to slow speed and the speed of the stacker 10 (if not automatic) is set to track the speed of the folder. The air pump 100 is turned on with the damper 112 in the open position. If the blanks are stacking well, the speed of the machines is gradually increased to running speed. If the blanks continue to stack well, no further adjustments are necessary; however, if the blanks tend to hang up or jam as they enter beneath the stack 14, the damper is gradually closed, thereby increasing the volume of air delivered by nozzle 96, until the blanks do stack well. When the desired number of blanks have been counted, the pusher 18 extends and pushes the top portion of the stack 14 between the belts 19 and skate conveyor 22 which further transport the bundle onto the lower skate conveyor 20 where it is tied or banded for further handling.

Although this invention has been described in connection with a particular type of stacking machine, it is not limited to such application. It will work equally well on other types of stackers which include means for advancing the blanks one at a time beneath a stack of blanks being formed. Those skilled in the art can easily utilize the teachings set forth herein to adapt the invention to the particular type of stacker being used.

Thus, the invention having been described in its best construction and mode of operation, that which is desired to be claimed by Letters Patent is:

1. Apparatus for directing a flow of air between the bottom blank of a stack of substantially rigid and folded blanks and a similar blank advancing beneath said stack comprising:

air supply means adjacent a trailing edge of said bottom blank in a position to direct said flow of air beneath said bottom blank and above said advancing blank to form a cushion of air therebetween for reducing friction between said bottom blank and said advancing blank during advancement of said advancing blank to substantially completely beneath said stack and to press said advancing blank against an advancing means used to advance said advancing blank beneath said stack, said air supply means including nozzle means inclined from horizontal no less than about 30° and no more than about 50° with a discharge end thereof being about one-half inch from a trailing edge of said bottom blank and about even with a bottom surface thereof and having an opening of about one-sixteenth to about one-quarter inch extending from about one-third to about the full width of said advancing blank for supplying air in a thin stream against said advancing blank at an exit elocity of no less than about 500 feet per minute and no more than about 8000 feed per minute.

2. The apparatus of claim 1 wherein said air supply means further includes:

damper means for controlling the volume of air discharged by said nozzle means.

3. The apparatus of claim 1 wherein said air supply means further includes:

control means for controlling the speed of said air pump means to control the volume of air discharged by said nozzle means.

4. The apparatus of claim 1 wherein:

said flow of air is discharged intermittently from said air supply means, beginning substantially at such time as a leading edge of said advancing blank reaches said nozzle means and ending at such time as a trailing edge of said advancing blank reaches said nozzle means.

* * * * *